United States Patent [19]

Lindaman

[11] Patent Number: 4,458,707

[45] Date of Patent: Jul. 10, 1984

[54] SPORTSMAN'S PORTABLE ROOF

[75] Inventor: Glenn Lindaman, Wescosville, Pa.

[73] Assignee: Sportsman's Portable Equipment Co., Easton, Pa.

[21] Appl. No.: 424,218

[22] Filed: Sep. 27, 1982

[51] Int. Cl.[3] ..... A45B 11/00

[52] U.S. Cl. ..... 135/90; 135/16

[58] Field of Search ..... 135/90, 96, 901, 902, 135/100, 98, 20 R, 21, 33 R, 34, 35 V, 35 S

[56] References Cited

U.S. PATENT DOCUMENTS

| | | | |
|---|---|---|---|
| 574,436 | 1/1897 | Lawrence | 135/33 R |
| 646,421 | 4/1900 | Fisher | 135/100 |
| 1,124,420 | 1/1915 | Gough | 135/90 |
| 2,631,520 | 3/1953 | Geerling | 135/90 |
| 4,086,931 | 5/1978 | Hall | 135/901 |
| 4,284,095 | 8/1981 | Norton | 135/90 |

FOREIGN PATENT DOCUMENTS

| | | | |
|---|---|---|---|
| 441592 | 1/1936 | United Kingdom | 135/35 |

*Primary Examiner*—Richard J. Apley
*Assistant Examiner*—S. R. Crow
*Attorney, Agent, or Firm*—Ruth Moyerman

[57] ABSTRACT

A sportsman's portable roof designed to be fastened to an extraneous support such as a tree trunk is disclosed. A fabric covered rib structure with a semi-eliptical opening in its cover is fastened to a support as by ties joined to the edges of the semi-eliptical opening. The device itself is held upright by fastening either its top cap or a handle attached to a shaft to the tree trunk with a belt and a hand screw. In use, the hunter is protected from the elements 360 degrees around the tree while having both hands free to practice his sport.

5 Claims, 7 Drawing Figures

SPORTSMAN'S PORTABLE ROOF

BACKGROUND OF THE INVENTION

1. Field of the Invention

This invention relates generally to canopies and more specifically to portable, tree-supported, hunter's shelters.

2. Description of the Prior Art

Many devices are known whose purpose is to protect a user from the elements, and many are of the umbrella type. Most umbrellas with a suspended center shaft require the user to use one hand for holding the umbrella. Hunters and other sportsman need both hands free to engage in their sport and have heretofor faced the elements without cover. Protection is particularly important to the sportsman who is subject to hypothermia during winter hunting season. There have been permanent duck blinds and the like for hunters, but no small portable protective device has been available for the mobile hunter.

Certain devices are known which are more or less portable—that is, designed to be nonpermanent. U.S. Pat. No. 3,545,461 to Carlson is an example of this type. Carlson's device operates more as a blind for the operator and is sizable and not rapidly dismountable. It also is more tent-like and is suspended by a cantilever from a tree. Another cantilevered shelter is U.S. Pat. No. 4,284,095 to Norton which is hung away from the tree trunk and allows rain to reach the user. Additionally Norton, which is a top hung umbrella, is subject to the common umbrella damage of being turned inside out in wind gusts and ruined. More portable shelters have been designed such as U.S. Pat. No. 2,970,600 to Schultz which provides a right angled shelter supported by legs pushed into the ground and which folds into a briefcase, and U.S. Pat. No. 4,112,957 to Biven which is designed to be used with a back pack.

There is, therefore, a great need for a truly portable sportsman's roof which is easily carried but which, most importantly, provides 360 degree protection around a tree and does so at tree trunk edge. That is, there is a need for a device which completely protects the user and his equipment by fitting snugly around a tree support. No device is known which provides this protection. There is also a need for a device which is simultaneously rough in construction, easy to operate, nondamaging to the environment by not requiring nails, etc., is inexpensive to produce, functions as a roof for the user and provides a knob for suspending firearms for rest.

SUMMARY OF THE DISCLOSURE

The aforementioned prior art problems are obviated by the device of this invention in which a sportsman's portable roof with a semi-eliptical opening is mounted so that it partially encapsulates a support, such as a tree trunk, creating a well protected area for a hunter.

The preferred embodiment of the device includes a center shaft with ribs pivotably attached to the shaft by runners and covered by a camouflage, waterproof material. A semi-eliptical opening in the roof cover has ties attached to the material to fasten the portable roof closely to a tree trunk. The entire portable roof is supported against the tree trunk by a parallelpipedal handle opposite the semi-eliptical opening and at the bottom of the portable roof shaft. This handle is mounted on a tree trunk by means of a hand screw threaded through a belt and then into a compatible T-nut in the handle so that the belt can be tightened to secure the handle to the tree.

The entire device may fit into a sheath case for carrying by hand or within a game bag or knapsack.

It is, therefore, an object of this invention to provide a device suitable for protecting the hunter from the elements while freeing his hands for operation of his other equipment.

It is another object of this invention to provide a device to protect the hunter from hypothermia.

It is yet another object of this invention to provide a device which is non-damaging to trees.

It is still another object of this invention to provide a device which provides a dry place for the primitive firearms hunters, e.g. flintlock guns, to help keep their powder dry.

Another further object of this invention is to provide a place to hang the hunter's gun to allow him to rest. It is a further object of this invention to provide a device which requires no assembly, but which is easily mounted on any vertical support.

It is yet a further object of this invention to provide a device which allows the user to stand right next to the tree so that his bodily outline may be broken by the tree which helps conceal him from, for example, deer.

It is still a further object of this invention to provide a device which is truly portable.

It is yet another object of this invention to provide a device which may employ either single action one piece ribs, or double action hinged ribs for support of the portable roof cover.

It is a further object of this invention to provide protection for the hunter's eyeglasses, telescopic scope and other accessories which may be damaged ot impaired in use by rain or snow.

These and other objects will be more readily ascertainable to those skilled in the art from a consideration of the following figures, descriptions and exemplary embodiments.

BRIEF DESCRIPTION OF THE DRAWING(S)

DETAILED DESCRIPTION OF THE PREFERRED EMBODIMENT(S)

Figure 1:
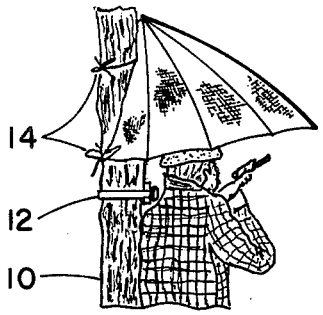
FIG. 1 depicts the device of this invention being used by a hunter.

Referring now to the drawings, and more particularly to FIG. 1, a hunter is illustrated under the sportsman's portable roof of this invention. The invention is attached to tree trunk 10 by belt 12 and ties 14. FIG. 1 readily shows the 360 degree protection afforded to the hunter and further shows that when using this invention, the user has the advantage of the camouflage provided by the tree and his hands are free to support his gun and to move his gun without interference from the portable roof.

Figure 2:
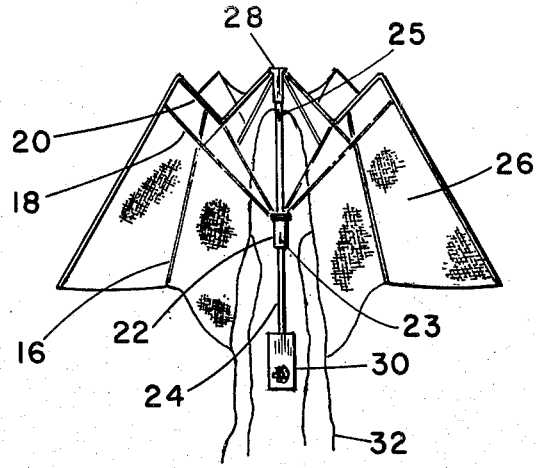
FIG. 2 shows the center shaft and ribs in a double action embodiment of the invention.

Referring now to FIG. 2, a preferred embodiment of this invention is illustrated in a partially open position. Ribs 16 are attached to hinged stretchers 18 at points 20. Hinged stretchers 18 are attached to slideable runner 22 which moves on shaft 24. When runner 22 is moved upward on shaft 24 to top cap catch 28, hinged stretchers 18 will extend outward to concavely bend ribs 16 and stretch waterproof cover 26 taut. Catch spring 23 on runner 22 locks in slot 25. Also shown are ties 32 extending from cover 26. Handle 30, attached to shaft 24, will be more fully described in FIG. 5.

Figure 3:
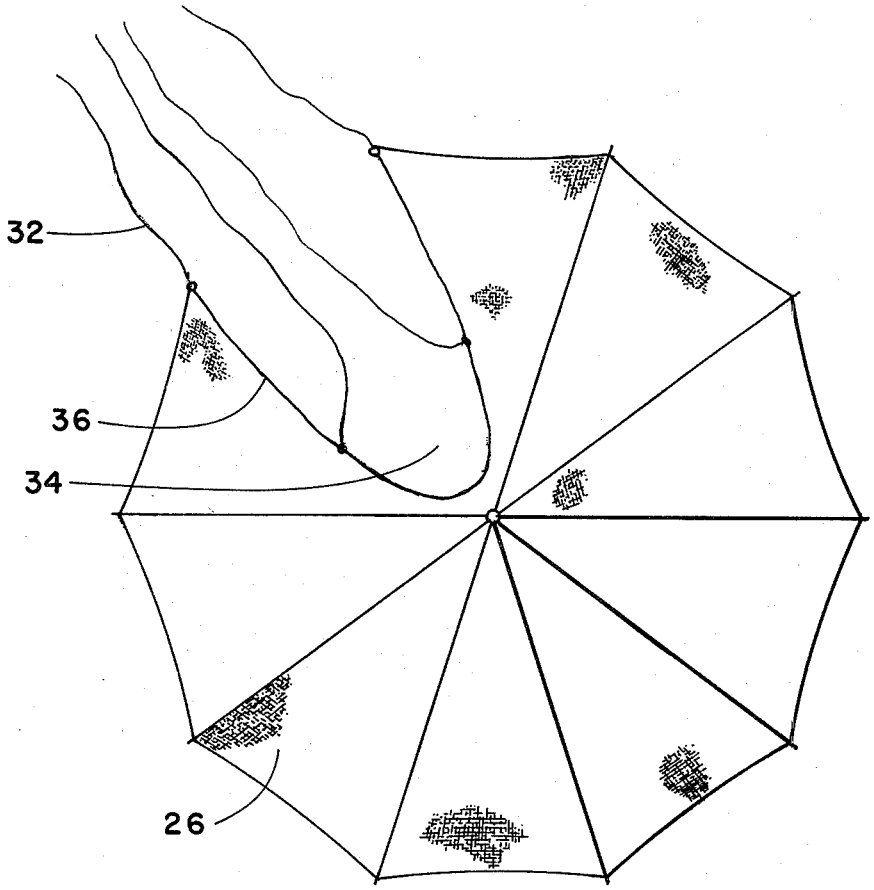
FIG. 3 is a top view of the invention.

In FIG. 3, a top view of the fully extended portable roof, waterproof cover 26 is shown having semi-eliptical cover opening 34 created by removing at least one rib 16 (not shown). Cover opening 34 may be edged by an abrasive resistant material on hem 36 to protect it when in use against the rough bark of trees. Ties 32 are sewn at hem 36. When the invention is in use, ties 32 are tied around a vertical support, such as a tree trunk, as shown in FIG. 1.

Figure 4:
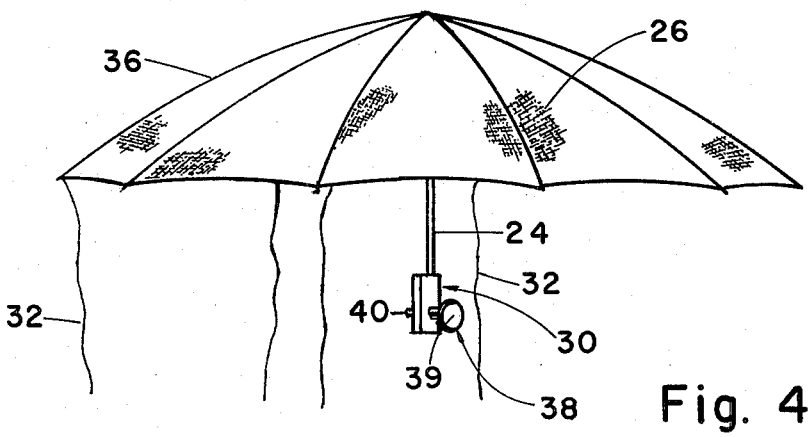
FIG. 4 is a side view of the invention.

FIG. 4 is a side view of the fully extended portable roof before attachment to a support. Cover 26 is shown having ties 32 hanging downward from edge 36. Shaft 24 is shown attached to handle 30. In addition, hand screw 38 is shown having knob 39 and shaft 40 extending through handle 30.

Figure 5:
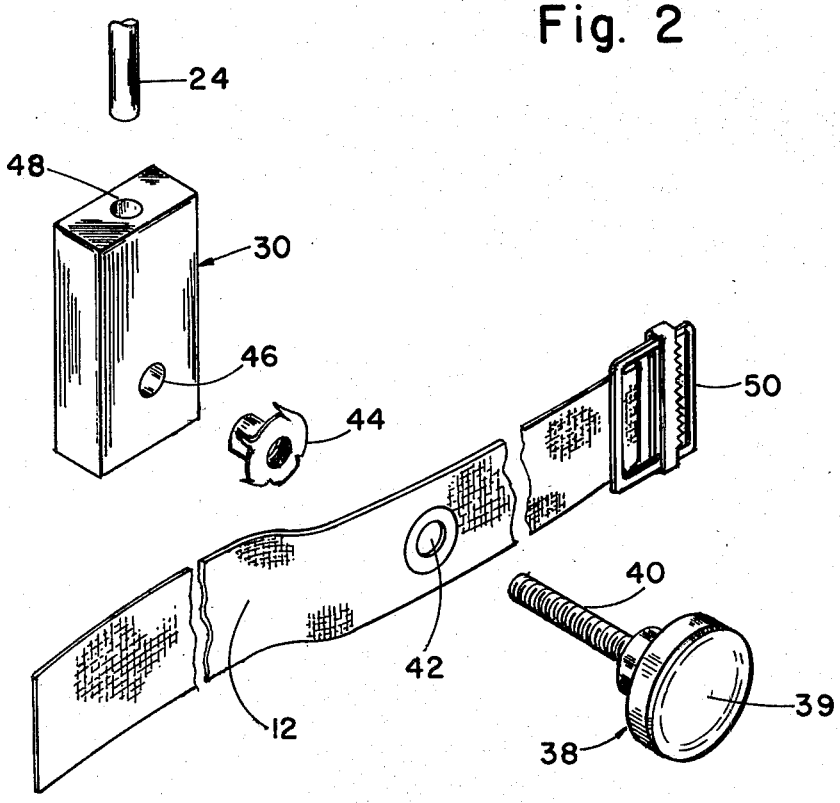
FIG. 5 is an exploded view of the parallelpipedal handle and belt for attachment of the invention to a support.

Referring now to FIG. 5, an exploded view of handle assembly 30 is shown to illustrate how the invention is secured to a support. Hand screw 38, having knob 39 and shaft 40, is placed through aperture 42 in belt 12. Hand screw 38 is then inserted through compatible T-nut 44 placed in horizontal cylindrical opening 46 extending horizontally through handle 30. Handle 30 has vertical cylindrical opening 48 into which shaft 24 is firmly inserted. The predetermined sizing of opening 48 prevents rotation of shaft 24.

To secure the invention to a support, belt 12 is secured around a tree at eye height and fastened with a standard buckle 50. Then hand screw 38 is tightened until handle 30 is secured against the support with shaft 24 in a vertical position. Ties 14 are then tied around the tree to encapsulate the support and provide a watertight connection to the support. Thus, when the portable roof is properly fastened to the extraneous support, the sportsman is protected from the elements and his hands are free to practice his sport as shown in FIG. 1.

Figure 6:
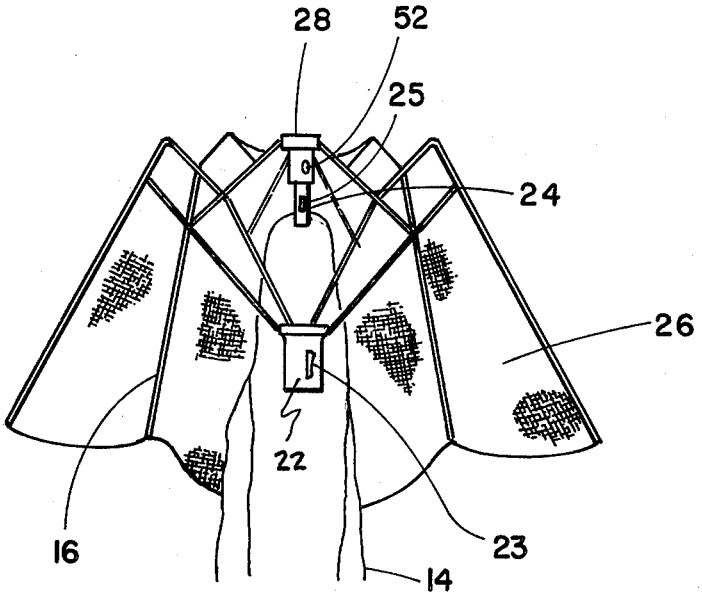
FIG. 6 shows the top cap, shortened shaft, ribs and runner in an alternative embodiment of this invention.

Now referring to FIG. 6, an alternative embodiment of the invention is seen. Shaft 24 has been shortened, but still includes slot 25. Runner 22 has catch spring 23 which will catch in slot 25 to open cover 26. Top cap 28 has been fitted with threaded hole 52 which receives hand screw 39 (seen in FIG. 7) to fasten the sportsman's roof to a tree without handle 30 or long shaft 24. Ties 14 will then be used as seen in FIG. 1.

Figure 7:
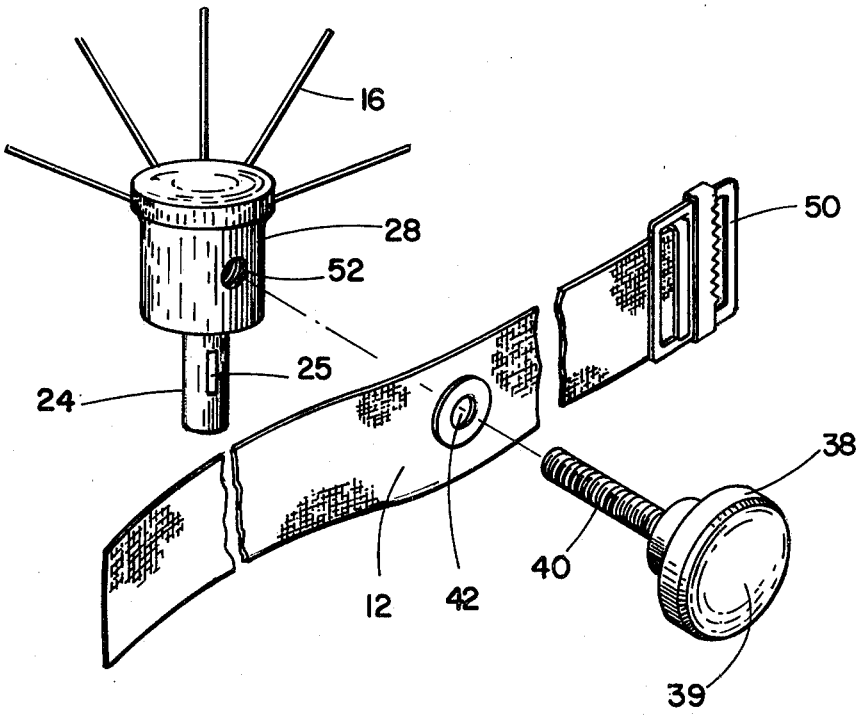
FIG. 7 is an exploded view of the belt, hand screw and top cap of an alternative embodiment of this invention.

Now referring to FIG. 7, shortened shaft 24 has slot 25. Top cap 28 has threaded hole 52 and ribs 16 extending from it. Hand screw 38 has knob 39 and pin 40. Pin 40 extends through aperture 42 in belt 12 and into threaded hole 52 in top cap 28. Belt 12 is then fastened around tree 10 in the same manner as described in FIG. 5.

There are many variations which may be practiced within the scope of this invention. Stretchers 18 are shown as hinged, but these are illustrative only and standard single action stretchers are also intended to be included within the scope of this invention.

T-nut 44 provides a convenient threading means for knob shaft 40, but is entirely optional and may be eliminated in favor of a threaded hole only.

Although the opening provided for encircling the tree or support is preferably semi-eliptical, any shape which performs the function may be substituted.

Also, camouflage material is preferred for the waterproof cover, but any color may be used.

It should be noted that shaft 24 and handle 30 may be omitted. In this instance, as the device is opened, catch spring 23 on runner 22 would still fasten in a slot 25. A threaded hold 52 in the top cap 28 would function to receive knob 39 and belt 12 as seen in FIGS. 6 and 7.

In place of ties, a zipper or other conventional fastening means may be substituted.

There are many advantages to the sportsman's portable roof of this invention. The instant device provides 360 degree protection for the hunter in the sense that the user of this device may shift his position, using the camouflage of the tree.

Secondly, because the hunter stands or sits flush against the tree, he not only has the advantage of the camouflage of the tree, but also enjoys the advantage of using the tree trunk to steady his weapon. This is a distinct advantage over the cantilevered devices of the past.

Another advantage is that this device is of particular use of both tree hunters and primitive firearm hunters. In the case of tree hunters, this group has never before had a device which would operate in their situation at all. The instant device, however, is just as easy to use several feet above the ground as it is on the ground level itself. Knob 39, which provides a rest from which the firearm may be suspended, is of particular value for the tree hunter who otherwise has no opportunity to either rest his arms and shoulders or to shift his position without danger of dropping his firearm or risking the dangerous alternative of laying it across a limb.

In regard to primitive firearm hunters, this is an area of increasing popularity and with these individuals, the ability to provide against-the-tree protection which is completely dry is not merely a convenience, but is imperative since the powder must be kept dry to be operative.

The instant invention has advantages over umbrella-like prior art devices in that the fastening of cover 26 itself to a tree prevents it from turning inside out due to wind gusts.

Lastly, it should be noted that many state laws prevent using nails, or any other devices which may endanger the environment. The portable roof of this invention has no adverse impact on the environment and is therefore acceptable under current regulations.

Having now illustrated and described my invention, it is not intended that such description limit this invention, but rather that this invention be limited only by a reasonable interpretation of the apended claims.

What is claimed is:

1. As a device, a sportsman's portable roof to be used in conjunction with an extraneous support object such as a tree trunk, comprising:

(a) a top cap;

(b) a runner;

(c) a plurality of ribs, pivotally attached to said top cap and extending radially outward therefrom, said ribs being distributed so that at least one rib has no diametrically opposed counterpart, to thereby create a semi-eliptical ribless sector;

(d) a plurality of stretchers, one end of each of which is pivotally attached to said runner and the other end of each of which is attached to a given rib;

(e) means to releasably lock said runner in said top cap;

(f) a fabric cover tacked to said ribs, said cover including a semi-eliptical opening in alignment with said semi-eliptical ribless sector;

(g) means to attach said opening's edge to said external support;

(h) a shaft attached at its one end to said top cap, said runner being slidably mounted on said shaft, said shaft including handle means at said shaft's other end; and, (i) means for mounting said device against said external support.

2. As a device, a sportsman's portable roof to be used in conjunction with an extraneous support object such as a tree trunk, comprising:

(a) a top cap;

(b) a runner;

(c) a plurality of ribs, pivotally attached to said top cap and extending radially outward therefrom, said ribs being distributed so that at least one rib has no diametrically opposed counterpart, to thereby create a semi-eliptical ribless sector;

(d) a plurality of stretchers, one end of each of which is pivotally attached to said runner and the other end of each of which is attached to a given rib;

(e) means to releasably lock said runner in said top cap;

(f) a fabric cover tacked to said ribs, said cover including a semi-eliptical opening in alignment with said semi-eliptical ribless sector, said cover opening edged in an abrasive-resistant material;

(g) means to attach said opening's edges to said external support; and, (h) means for mounting said device against said support, said means comprising a belt mounted on said top cap for encircling said support and a hand screw of a size to be threaded through an aperture in said top cap, whereby when said belt has been secured around said support, said hand screw may be tightened to firmly hold said sportsman's roof in unmoving contact with said support.

3. The sportsman's portable roof according to claim 1 wherein said means for mounting said device against said support comprises a belt mounted on said handle for encircling said support and a hand screw of a size to be threaded through an aperture in said belt, whereby when said belt has been secured around said support, said hand screw may be tightened to firmly hold said sportsman's roof in unmoving contact with said support.

4. The sportsman's portable roof according to claim 3 wherein said belt is fastened by a saw toothed buckle.

5. The sportsman's portable roof according to claim 3 wherein said hand screw includes a handle means to facilitate turning and to act as a firearms support member.

* * * * *